US011906159B2

(12) United States Patent
Monfared et al.

(10) Patent No.: US 11,906,159 B2
(45) Date of Patent: Feb. 20, 2024

(54) FRUSTOCONICAL COMBUSTION CHAMBER FOR A FLUID HEATING DEVICE AND METHODS FOR MAKING THE SAME

(71) Applicant: Rheem Manufacturing Company, Atlanta, GA (US)

(72) Inventors: Amin Monfared, Oxnard, CA (US); Leonard E. Chambers, Oxnard, CA (US); Miguel Mendoza, Oxnard, CA (US); Arash Jafari, Oxnard, CA (US); Babak Bagheri, Oxnard, CA (US); Bruce Hotton, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/588,434

(22) Filed: Jan. 31, 2022

(65) Prior Publication Data

US 2022/0146091 A1 May 12, 2022

Related U.S. Application Data

(63) Continuation of application No. 16/858,904, filed on Apr. 27, 2020, now Pat. No. 11,236,902.

(51) Int. Cl.

| | |
|---|---|
| ***F24H 1/20*** | (2022.01) |
| ***F23C 3/00*** | (2006.01) |
| ***F24H 1/14*** | (2022.01) |
| ***F24H 9/1836*** | (2022.01) |

(52) U.S. Cl.

CPC ..... *F23C 3/00* (2013.01); *F24H 1/145* (2013.01); *F24H 9/1836* (2013.01)

(58) Field of Classification Search

CPC ..... F24H 1/205; F24H 1/287; F24H 1/145; F24H 9/1836; F23C 3/00

See application file for complete search history.

(56) References Cited

U.S. PATENT DOCUMENTS

| | | | | |
|---|---|---|---|---|
| 4,271,789 | A | 6/1981 | Black | |
| 5,197,456 | A | 3/1993 | Ryno | |
| 5,233,755 | A * | 8/1993 | Vandendriessche | F02K 9/64 60/222 |
| 10,935,278 | B2 | 3/2021 | Park et al. | |

(Continued)

FOREIGN PATENT DOCUMENTS

| | | | |
|---|---|---|---|
| CN | 102748115 | A | 10/2012 |
| GB | 156432 | A | 1/1921 |

(Continued)

OTHER PUBLICATIONS

International Search Report and Written Opinion for PCT/US2021/028317 dated Aug. 5, 2021.

*Primary Examiner* — Gregory A Wilson

(74) *Attorney, Agent, or Firm* — Eversheds Sutherland (US) LLP

(57) ABSTRACT

The disclosed technology includes a fluid heating device including a frustoconical combustion chamber and a heat exchanger that can include heating tubes. The combustion chamber can have a first end and a second end that is in fluid communication with the heating tubes. The surface area of the second end of the combustion chamber can be larger than the surface area of the first end of the combustion chamber.

19 Claims, 8 Drawing Sheets

(56) References Cited

U.S. PATENT DOCUMENTS

| | | | |
|---|---|---|---|
| 11,236,902 | B2 | 2/2022 | Monfared et al. |
| 2009/0165733 | A1 | 7/2009 | Ferguson |
| 2019/0041092 | A1 | 2/2019 | Niu et al. |

FOREIGN PATENT DOCUMENTS

| | | | | |
|---|---|---|---|---|
| GB | 311547 | A | 5/1929 | |
| GB | 1143295 | A | 2/1969 | |
| RU | 14636 | U1 | 8/2000 | |
| RU | 2451881 | C2 | 5/2012 | |
| WO | 2013-F09780 | A2 | 4/2013 | |
| WO | WO-2013048269 | A2 * | 4/2013 | ..... F24H 1/287 |

* cited by examiner

FRUSTOCONICAL COMBUSTION CHAMBER FOR A FLUID HEATING DEVICE AND METHODS FOR MAKING THE SAME

CROSS-REFERENCE TO RELATED APPLICATIONS

The present application is a continuation of U.S. patent application Ser. No. 16/858,904 filed 27 Apr. 2020, the entire contents of which is incorporated herein by reference.

FIELD OF THE DISCLOSURE

The present invention relates generally to a fluid heating device including a combustion chamber, and more particularly, to a frustoconical combustion chamber for improved heat transfer efficiency.

BACKGROUND

Fluid heating devices are commonly used in residential and industrial applications to provide on demand heated water supply. Gas-fueled fluid heaters typically include a combustion chamber in which the incoming air/fuel mixture can be ignited to produce combustion gases that can be passed through a heat exchanger to heat passing fluid. Traditionally, combustion chambers have a cylindrical shape, perhaps because of the ease of manufacturing a cylindrical combustion chamber from a flat piece of material. However, a cylindrical combustion chamber can be unable to facilitate sufficiently energy-efficient flow of combustion gases generated during the combustion process. That is, cylindrical combustion chambers often have dead zones in which the incoming flow of air/fuel mixture and/or the direct flow of combustion gases do not reach. Instead, recirculation of combustion gases can occur in these dead zones. As an example, these dead zones can be located in the upper corners of a cylindrical combustion chamber. Combustion gases can become trapped in these dead zones, preventing the combustion gases from flowing through the heat exchanger and thus preventing the combustion gases from adding heat a fluid via the heat exchanger. Therefore, recirculation can hinder heat transfer efficiency.

Additionally, a cylinder combustion chamber can result in an inefficiently large space between a burner and the outer edge of the top surface of the combustion chamber. This space can result in a loss of heat unless it is properly insulated, which requires additional material, such as refractory lining. However, the amount of refractory lining required to insulate the top of the combustion chamber can be an otherwise unnecessary manufacturing cost. Therefore, a design that that can reduce the space requiring insulation would provide a less expensive fluid heating device.

Furthermore, assembly of a fluid heating device can require a minimum amount of space between the combustion chamber and the outer shell of the fluid heating device (e.g., at the top end of the fluid heating device near the top end of the combustion chamber) to accommodate for welding or other tools. At the same time, the bottom end of the combustion chamber must be large enough to cover all heating tubes of the heat exchanger such that combustion gases can flow from the combustion chamber and into the heating tubes. Further, to effect efficient heat transfer to passing fluid, the outer edge or surface of the heat exchanger should be within a certain distance from the inner surface of the outer shell. If the distance between the heat exchanger and the outer shell becomes too great, fluid may flow past the heat exchanger (e.g., along the inner surface of the outer shell) without receiving sufficient heat energy from the heat exchanger.

Thus, the difference between the outer diameter of the heat exchanger and the inner diameter of the outer shell is ideally small enough to effect efficient heat transfer to the passing fluid. However, in existing systems, the diameter of the heat exchanger is typically limited by the diameter of the bottom end of the combustion chamber, which is attached to the heat exchanger (because the combustion chamber must cover all heating tubes of the heat exchanger), and the diameter of the bottom end of the heat exchanger is typically limited with respect to the inner diameter of the by the inner diameter of the outer shell because of the requirement for certain tools during manufacturing or assembly. Thus, existing systems can often have a gap between the outer diameter of the heat exchanger and the inner diameter of the outer shell that is too large to provide efficient heat transfer to passing fluid.

SUMMARY

These and other problems can be addressed by the technologies described herein. Examples of the present disclosure relate generally to a fluid heating device including a frustoconical combustion chamber.

The disclosed technology includes a fluid heating device including an outer shell having a fluid inlet and a fluid outlet. The outer shell can define a fluid heating volume for heating fluid. The fluid heating device can include a heat exchanger disposed substantially within the outer shell. The heat exchanger can include heating tubes that are each fluidly isolated from the fluid heating volume. The fluid heating device can include a combustion chamber in fluid connection with the heating tubes of the heat exchanger. The combustion chamber can have a first end and a second end that is in fluid communication with the heating tubes. The surface area of the second end can be larger than the surface area of the first end such that the combustion chamber can have a substantially frustoconical shape.

The disclosed technology also includes a method of manufacturing a fluid heating device including a frustoconical combustion chamber. The method can include providing an outer shell having a fluid inlet and a fluid outlet and positioning a heat exchanger within the outer shell. The heat exchanger can include an inlet tube sheet attached proximate a first end of the heat exchanger, an outlet tube sheet attached proximate a second end of the heat exchanger, and a plurality of heating tubes extending between the inlet tube sheet and the outlet tube sheet. The method can include attaching a frustoconical combustion chamber to the heat exchanger such that the combustion chamber is in fluid communication with the heating tubes. The frustoconical combustion chamber can have a first end that has a first surface area and a second end that has a second surface that is greater than the first surface area. The method can include connecting a blower system to the first end of the combustion chamber, such that the blower system can provide an air/fuel mixture to the combustion chamber.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1A:
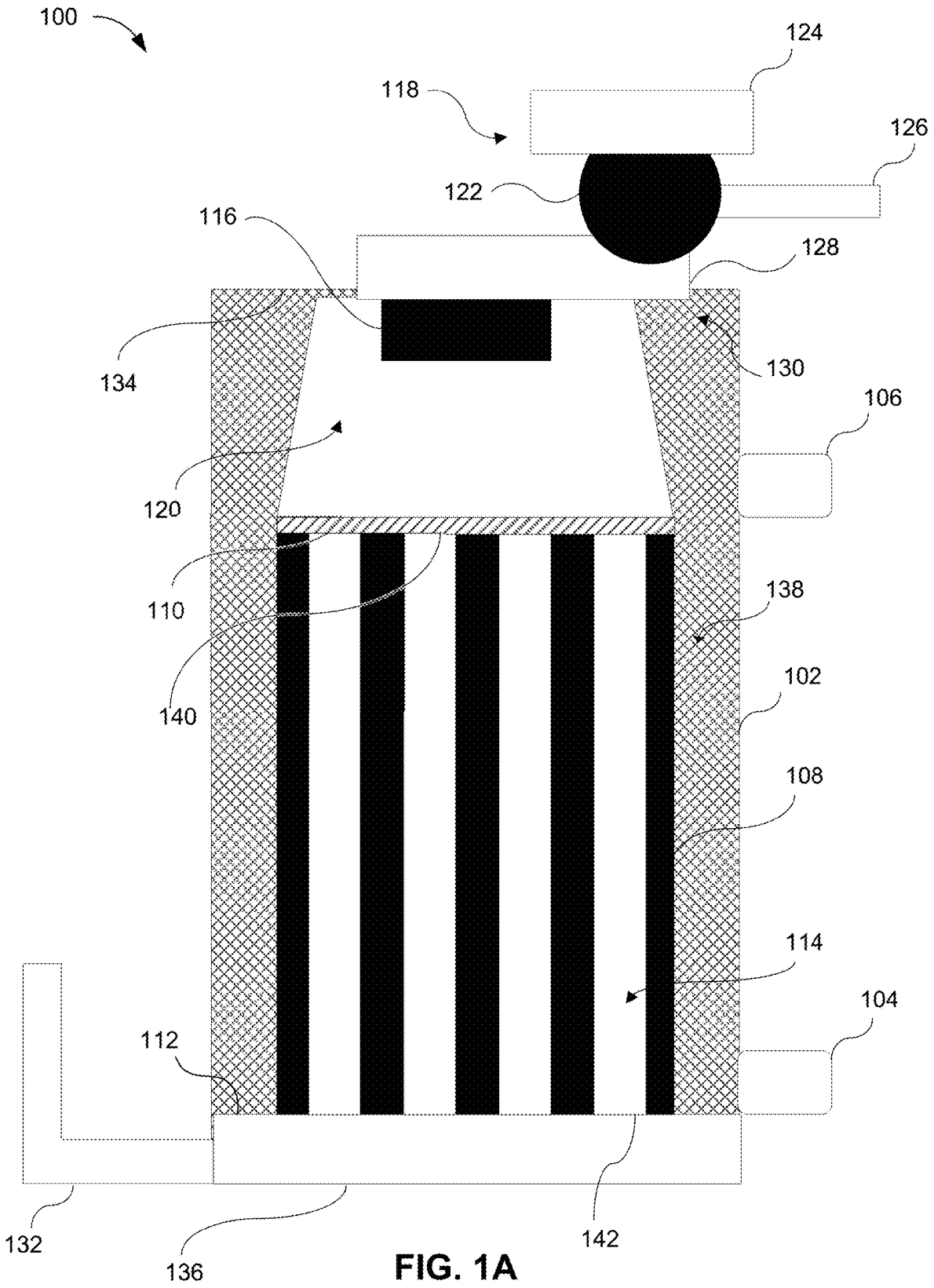
FIG. 1A illustrates a fluid heating device, in accordance with the disclosed technology.

The disclosed technology relates to a fluid heating device including a frustoconical combustion chamber in fluid communication with a heat exchanger. The frustoconical shape of the combustion chamber allows the heat exchanger to be positioned close to the outer shell of the heating device, resulting in efficient heat transfer from the hot combustion gases flowing through the heat exchanger to the fluid flowing in the space between the outer shell and the heat exchanger.

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween.

Referring now to the drawings, FIG. 1A is a diagram of a fluid heating device 100 including a frustoconical combustion chamber 120. The components and arrangements shown in FIG. 1A are not intended to limit the disclosed embodiments as the components used to implement the disclosed processes and features may vary. That is, while certain principles of the present invention are described as being incorporated in a gas-fired water heater, this example is non-limiting, and it will be readily appreciated by those skilled in the art that fuel-fired heating appliances of other types including boilers or fuel-fired furnaces may be alternatively utilized. For example, the arrangement of components shown in FIG. 1A can be used with alternative designs of a combustion chamber 120, such as the various designs discussed herein.

The fluid heating device 100 can be a gas-fired water heater, such as a down-fired water heater, for example. In a down-fired water heater, hot combustion gases can flow downwards through tubes of a heat exchanger of the fluid heating device 100 to heat the fluid within the fluid heating device 100. The fluid within the fluid heating device 100 can optionally include additives, such as antifreeze or the like.

The fluid heating device 100 can include an outer shell 102, with a heat exchanger 108 disposed substantially within the outer shell 102, and the heat exchanger 108 can be configured to transfer heat to fluid within the outer shell 102. The heat exchanger 108 can include a blower system 118 (e.g., proximate a top end 110 of the fluid heating device 100). The blower system 118 can include a blower 122, an air inlet 124 to receive air for combustion and a fuel inlet 126 to receive fuel for combustion. A fuel source (e.g., a fuel supply line) can be fluidly connected to the fuel inlet 126. The blower system 118 can include a control valve to regulate the amount of fuel entering the blower 122. The control valve can be a zero-governor modulating gas valve for providing fuel to the blower 122 at a variable gas rate, which can be proportional to the negative air pressure within the blower system 118 caused by the speed of the blower 122, which can help maintain a predetermined air to fuel ratio. The blower 122 can then transfer a pre-mixed air/fuel mixture to a manifold 128, which can be fluidly connected to a combustion chamber 120. The combustion chamber 120 can include an igniter 116, which can ignite the incoming air/fuel mixture, resulting in combustion of air/fuel mixture (i.e., combustion gases). The combustion chamber 120 can be in fluid connection with tubes 114 of the heat exchanger 108 such that the hot combustion gases can pass through the tubes 114, until the combustion gases eventually reach a flue 132. The exterior of the heat exchanger 108 can be in communication and/or contact with the fluid within the fluid heating device 100 such that heat can be transferred from the hot combustion gases to the fluid via the heat exchanger 108.

The fluid heating device 100 can include a vertically-oriented, cylindrical outer shell 102, which can be adapted to hold and heat fluid. Alternatively, the outer shell 102 can have a different geometry and/or cross-sectional shape. For example, the outer shell 102 can have a shape that is a cube, a vertically-oriented rectangular prism or can be a rectangular prism having rounded edges. Alternatively, the outer shell 102 can be horizontally oriented and can have a shape that is substantially a cylinder, a cube, a rectangular prism, or a rectangular prism with rounded edges. As a nonlimiting example, a horizontally oriented outer shell 102 can be used in an industrial setting in which it can be necessary to heat large amounts of fluid. The outer shell 102 can include copper, iron, steel, any combination or alloy thereof, or the like. The fluid heating device 100 can include an insulating jacket can surround the outer shell 102. The insulating jacket can have an annular outer metal jacket portion, which can be coaxial with the outer shell 102. Any suitable insulation material, such as foam, can be disposed within the annular space between the metal jacket portion and the outer shell 102. The outer shell 102 can include a plurality of connection points, including a fluid inlet 104 and a fluid outlet 106, to fluidly connect to a water system. The fluid inlet 104 can receive cold fluid. The fluid inlet 104 can be located near or proximate a bottom surface 136 of the outer shell 102, as illustrated in FIG. 1A. The fluid outlet 106 can dispense heated fluid for on-demand delivery of heated fluid. The fluid outlet 106 can be connected to a heated water supply pipe of the water system and can be configured to dispense heated fluid various devices and fixtures, including sinks, dishwashers, tubs, and the like. The fluid outlet 106 can be located near or proximate a top surface 134 of the outer shell 102, as illustrated in FIG. 1A.

The heat exchanger 108 disposed within the outer shell 102 and can have a substantially cylindrical shape. Alternatively, the heat exchanger 108 can have a cuboid shape. The heat exchanger 108 can have a shape or geometry that mirrors the shape or geometry of the outer shell, which may increase the efficiency of heat transfer to the fluid. The heat exchanger 108 can be coaxially aligned with the outer shell 102. The heat exchanger 108 can include thermally conductive metals, including copper, iron, steel, any combination or alloy thereof, or the like. The interior of the heat exchanger 108 can be coated with ceramics (e.g., porcelain, composites, plastic polymers) or other material(s) to protect the internal surfaces (e.g., surfaces encountering the combustion gases) of the heat exchanger 108. Alternatively or in addition, the exterior of the heat exchanger 108 can be coated with ceramics, composites, plastic polymers, or other material(s) to protect the external surfaces (e.g., surfaces encountering the fluid) of the heat exchanger 108, which can increase the useful life of the fluid heating device 100.

Figure 1B:
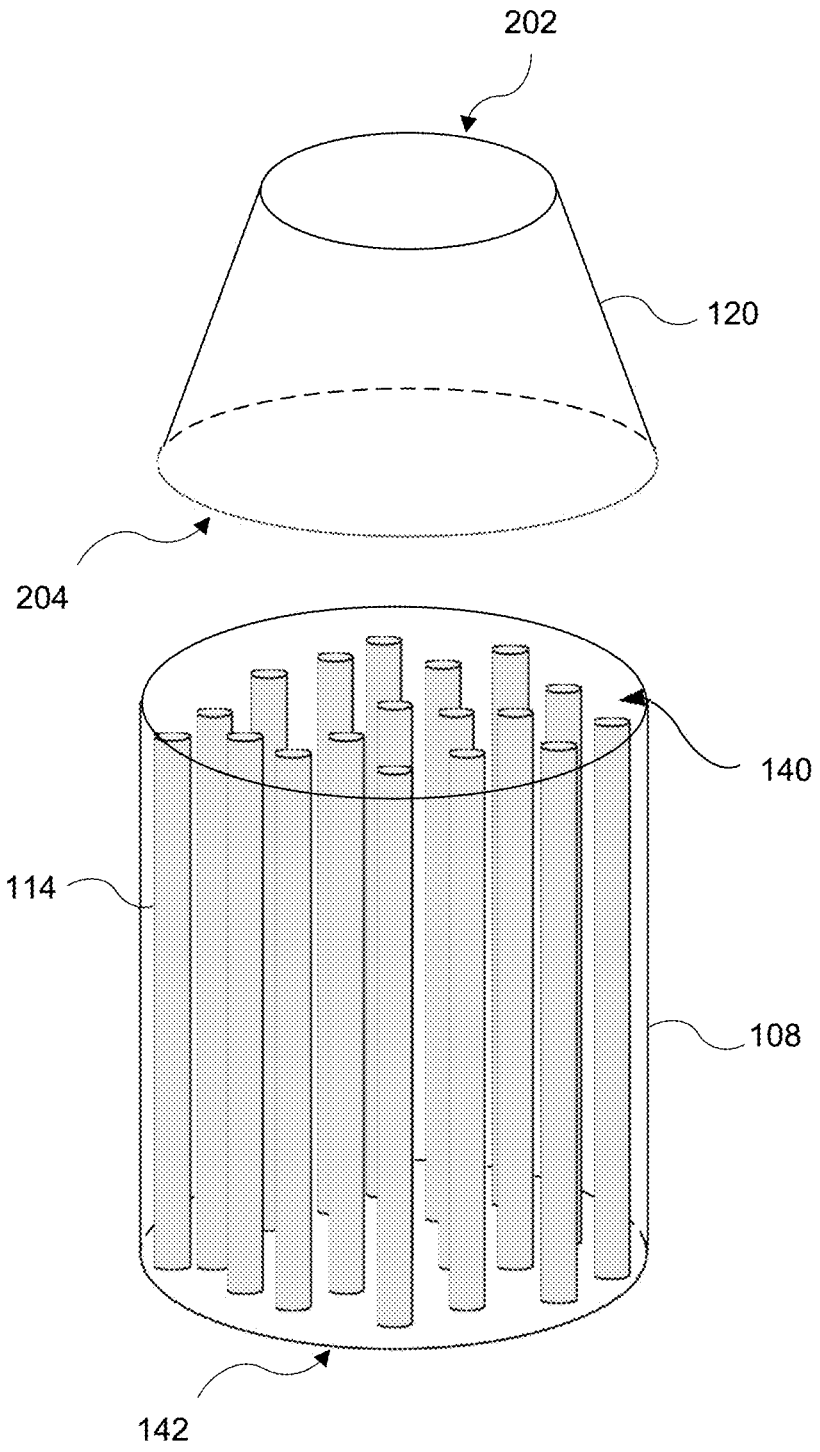
FIG. 1B illustrates a diagram of a heat exchanger, in accordance with the disclosed technology.

As illustrated in FIG. 1B, the heat exchanger 108 can have a top end (i.e., first end) 110 and a bottom end (i.e., second end) 112. An inlet tube sheet 140 can be disposed proximate the top end 110 and an outlet tube sheet 142 can be disposed on the bottom surface 112. The inlet tube sheet 140 can be attached to the first end 110 (e.g., welded to the outer circumference of the heat exchanger 108 at or near the first end 110). The outlet tube sheet 142 can similarly be attached to the second end 112 (e.g., welded to the outer circumference of the heat exchanger 108 at or near the second end 112). Alternatively, the inlet tube sheet 140 and the outlet tube sheet 142 can be removably attached to the outer circumference of the first end 110 or second end 112, respectively, of the heat exchanger 108.

The inlet tube sheet 140 and the outlet tube sheet 142 can each include a plurality of apertures, and the apertures of the inlet tube sheet 140 can align with the apertures of the outlet tube sheet 142, as illustrated in FIG. 1B. Each aperture can be configured to receive and/or align with a tube 114. For example, the inlet tube sheet 140 and outlet tube sheet 142 can include a plurality of apertures to receive at least one hundred tubes 114. Each tube 114 can extend from the inlet tube sheet 140 to the outlet tube sheet 142 (e.g., designed such that each tube 114 is a single pass tube). Alternatively, the tubes 114 can be designed such that the number of tube passes is two, four, six, eight, or any other number of tube passes. The tubes 114 can include one or more material capable of transferring heat. For example, the tubes 114 can include thermally conductive metal including, steel, carbon steel stainless steel, nickel, titanium, aluminum, copper, any combination or alloy thereof, and the like. The tubes 114 can each have a fixed cross section. Alternatively or in addition to, one or more tubes 114 can have a variable cross section (e.g., the diameter can change along the length of a given tube 114). The tubes 114 can any useful geometry or cross-sectional shape, including but not limited to, helical, dimpled, cylindrical, and/or ribbon shaped. The plurality of tubes 114 can be arranged in an array. The array can have a variety of configurations which can include but are not limited to a circular array, a rectangular array, a triangular array, or a polygonal array. The array can form a grid or multiple grids (e.g., grids offset from one another). The heat exchanger 108 can include one or more baffles, which can provide additional support to the plurality of tubes 114 and direct the flow of the fluid as the fluid flows through the heat exchanger 108.

Referring back to FIG. 1A, a channel 138 can be created between an inner wall of the outer shell 102 and an outer wall of the heat exchanger 108. The channel 138 can provide a passageway for fluid to flow from the fluid inlet 104 to the fluid outlet 106, as illustrated in FIG. 1. The diameter of the channel 138 can be advantageously small in order for the fluid to gain more heat radiating from the hot combustion gases flowing through the plurality of tubes 114 within the heat exchanger 108 and minimize any loss of heat transfer. This can result in improved heat transfer efficiency.

The fluid heating device 100 can include a combustion chamber 120. The combustion chamber 120 can provide a space for combustion of an air/fuel mixture. Combustion of the air/fuel mixture within the combustion chamber 120 can generate combustion gases that can serve as the source of heat for heating the fluid flowing through the fluid heating device 100. The combustion chamber 120 can receive hot gas, steam, or the like that can flow through the plurality of tubes 114, providing the source of heat for heating the fluid.

The combustion chamber 120 can be disposed proximate to the heat exchanger 108, as illustrated in FIG. 1A. The combustion chamber 120 can be welded to the outer circumference of the top end 110 of the heat exchanger 108. The combustion chamber 120 can be removably fixed to the outer circumference of the top end 110 of the heat exchanger 108. The combustion chamber 120 and the top end 110 of the heat exchanger 108 can be positioned coaxially such that the outer circumference of the heat chamber 120 and the outer circumference of the top end 110 of the heat exchanger 108 can be in direct alignment.

The combustion chamber 120 can include an igniter 116 within the combustion chamber 120. The igniter 116 can have multiple configurations. Alternatively, the igniter 116 can have a substantially rectangular pyramid, frustoconical, or hemi-spherical shape. The alternative configurations can potentially better direct the combustion gases and resulting heat towards the plurality of tubes 114 within the heat exchanger 108.

The blower system 118 can be disposed adjacent to, near, or proximate the combustion chamber 120 and a top surface 134 of the outer shell 102. As mentioned above, the blower system 118 can include a blower 122, an air inlet 124, a fuel inlet 126, and/or a manifold 128. The manifold 128 can be positioned adjacent to, near, or proximate the top end 202 of the combustion chamber 120. The manifold 128 can have a plurality of openings that can each provide a passageway for the air/fuel mixture to enter the combustion chamber 120. The plurality of openings can help evenly distribute the flow of air/fuel mixture into the combustion chamber 120. The manifold 128 can be attached (e.g., welded) to or near the top surface 134 of the outer shell 102. To provide room for attachment tool (e.g., a welding tool) during manufacturing, the top end 202 of the combustion chamber 120 can be sized to accommodate the attachment tool. That is, the combustion chamber can be sized and dimensioned such that, when the combustion chamber 120 is positioned inside the outer shell 102, a gap 130 can be formed proximate the top end 202 of the combustion chamber 120 between the exterior surface of the combustion chamber 120 and the interior surface of the outer shell 102, and this gap 130 can be sufficiently large to accommodate the attachment tool. The manifold 128 or some other component can thus be welded or otherwise attached to the fluid heater 100. The manifold 128 can be positioned such that at least some of the plurality of openings can approximately align with the igniter 116 located within the combustion chamber 120. The igniter 116 can be configured to ignite the air/fuel mixture to cause the air/fuel mixture to combust and generate combustion gases. The combustion gases can subsequently flow through the plurality of tubes 114 within the heat exchanger 108, heating the fluid within the fluid heating device.

As will be appreciated, the tubes 114 can be distributed throughout the cross-sectional area of the heat exchanger 108. Further, the tubes 114 must be fluidly connected to the combustion chamber 120 to receive hot combustion gases and transfer heat to the fluid. Thus, the amount and/or efficiency of heat transfer to the fluid can be influenced by the surface area of the end of the combustion chamber 120 that is attached or connected to the heat exchanger 108 (i.e., the second end of the combustion chamber 120) In existing systems, the size of the heat exchanger can be limited by the size of the combustion chamber because the combustion chamber must envelop or cover all heating tubes of the heat exchanger in order to maintain fluid communication with the heating tubes. However, the size of the combustion chamber can be limited due to the space required for an attachment tool during manufacturing (i.e., space near the top of the combustion chamber and between the exterior surface of the combustion chamber and the interior surface of the outer shell). To compensate for the limiting effect of the combustion chamber, existing systems typically provide an oversized outer shell, which can permit the combustion chamber to fully cover all heating tubes of the heat exchanger while also providing sufficient room between the combustion chamber and outer shell for assembly. This, however, can introduce an additional issue. In particular, providing an oversized outer shell increases the width of the channel formed between the exterior surface of the heat exchanger and the interior surface of the outer shell. This, in turn, can reduce the efficacy and/or efficiency of heat transfer between the heat exchanger and passing fluid. More specifically, some fluid may flow along the wall of the outer shell, which can be a large enough distance away from the heat exchanger such that the water immediately adjacent the outer shell does not receive sufficient heat energy from the heat exchanger.

To simultaneously address these issues, the combustion chamber 120 of the disclosed technology can have a substantially frustoconical shape. The frustoconical combustion chamber 120 can provide effective heat transfer between the radiating heat from the combustion gases flowing through the plurality of tubes 114 within the heat exchanger 108 and the fluid within the heat exchanger 108. The smaller diameter of the top end 202 of the combustion chamber 120 can provide a gap 130 between the combustion chamber 120 and the outer shell 102 that is sufficiently large to accommodate a welding or other tool necessary during manufacturing or assembly (e.g., to weld the blower system 118 to the top surface 134 of the outer shell 102). Alternatively or in addition, the gap 130 can provide an increased volume beside the combustion chamber 120 and/or heat exchanger 108 for the inclusion of flow-influencing features (e.g., those disclosed in U.S. Pat. No. 11,333,398 to Rheem Manufacturing Co., the entire contents of which are incorporated herein), which can influence and/or enhance the flow pattern of fluid passing along the outside of the combustion chamber 120 and/or heat exchanger 108 to increase and/or improve heat transfer to the fluid. The larger diameter of the bottom end 204 of the combustion chamber 120 can allow the bottom end 204 to fully cover all heating tubes of the heat exchanger 108 (and/or enable the edge of the bottom end 204 to be approximately flush with the edge of the top end 110 of the heat exchanger 108), while also reducing the width of the channel 138 between the inner wall of the outer shell 102 and the outer wall of the heat exchanger 108. The fluid flowing through the channel 138 can be heated more efficiently as compared to when a cylindrical combustion chamber is used, as the fluid can absorb more of the heat radiating from the heat exchanger 108 due to the smaller width of the channel 138.

Further, the flow of combustion gases in the combustion chamber 120 can have a substantially conical or frustoconical shape. The frustoconical combustion chamber 120 can be designed to imitate or substantially mirror the general conical or frustoconical shape of the flow of combustion gases. Thus, the frustoconical combustion chamber 120 can direct the flow of combustion gases from the combustion chamber 120 to the plurality of tubes 114 disposed within the heat exchanger 108 efficiently and effectively. The substantial similarity in configuration of the frustoconical combustion chamber 120 and the flow of combustion gases can minimize recirculation within the upper corners of the combustion chamber 120 (or other portions of the combustion chamber 120), improving flow of the combustion gases to the heat exchanger 108.

The fluid heating device 100 can also include a flue 132 disposed proximate to a bottom surface 136 of the outer shell 102. The flue can serve as a duct for smoke and waste gases produced by the fluid heating device 100 upon combustion. The flue can exhaust the combustion gases flowing through the plurality of tubes 114 of the heat exchanger 108. The flue 132 can be connected to a pipe that further exhausts the combustion gases. The pipe can direct the combustion gases to a chimney, exhausting the combustion gases from the fluid heating device 100.

Figure 2A:
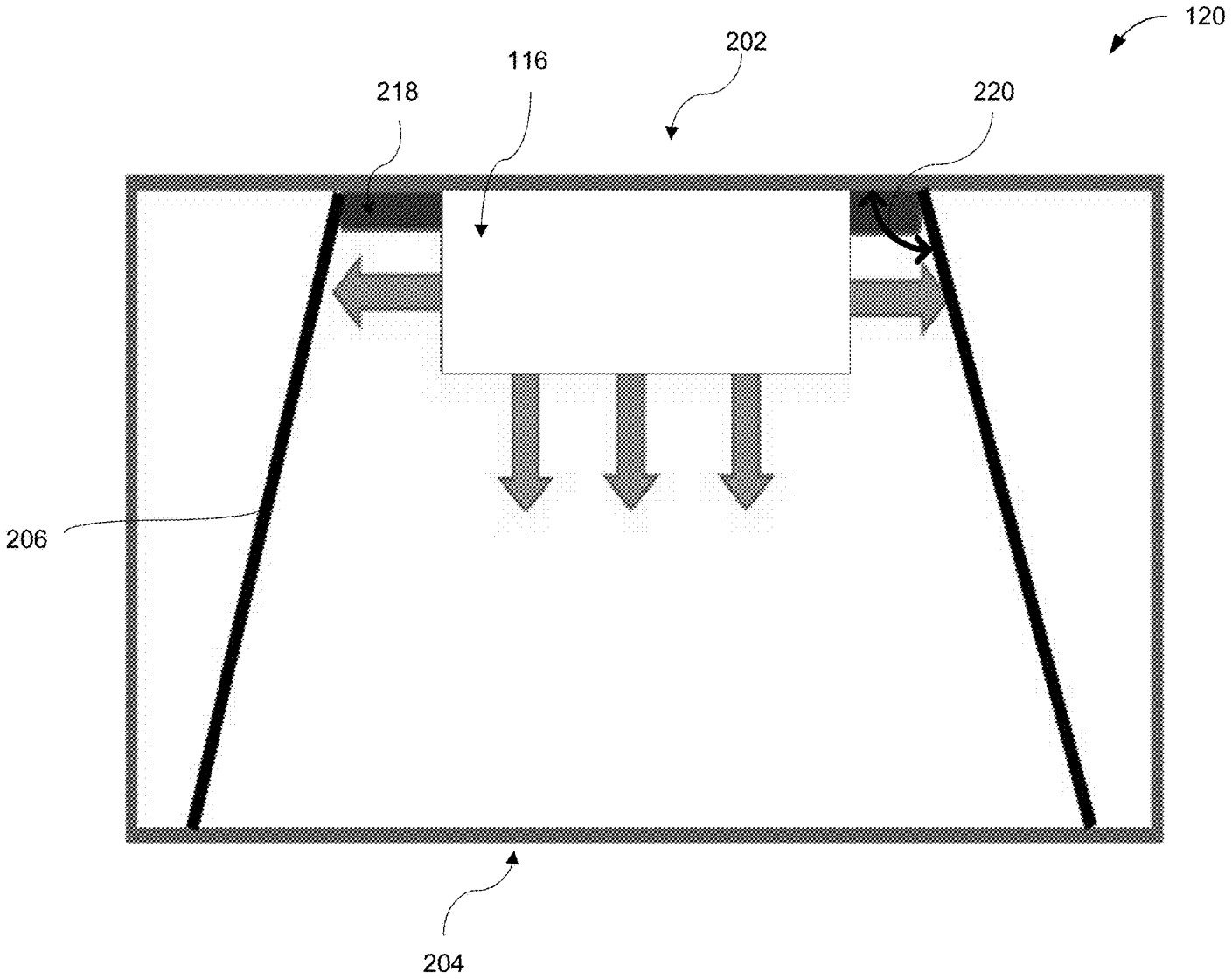
FIG. 2A illustrates a frustoconical combustion chamber, in accordance with the disclosed technology.
Figure 2B:
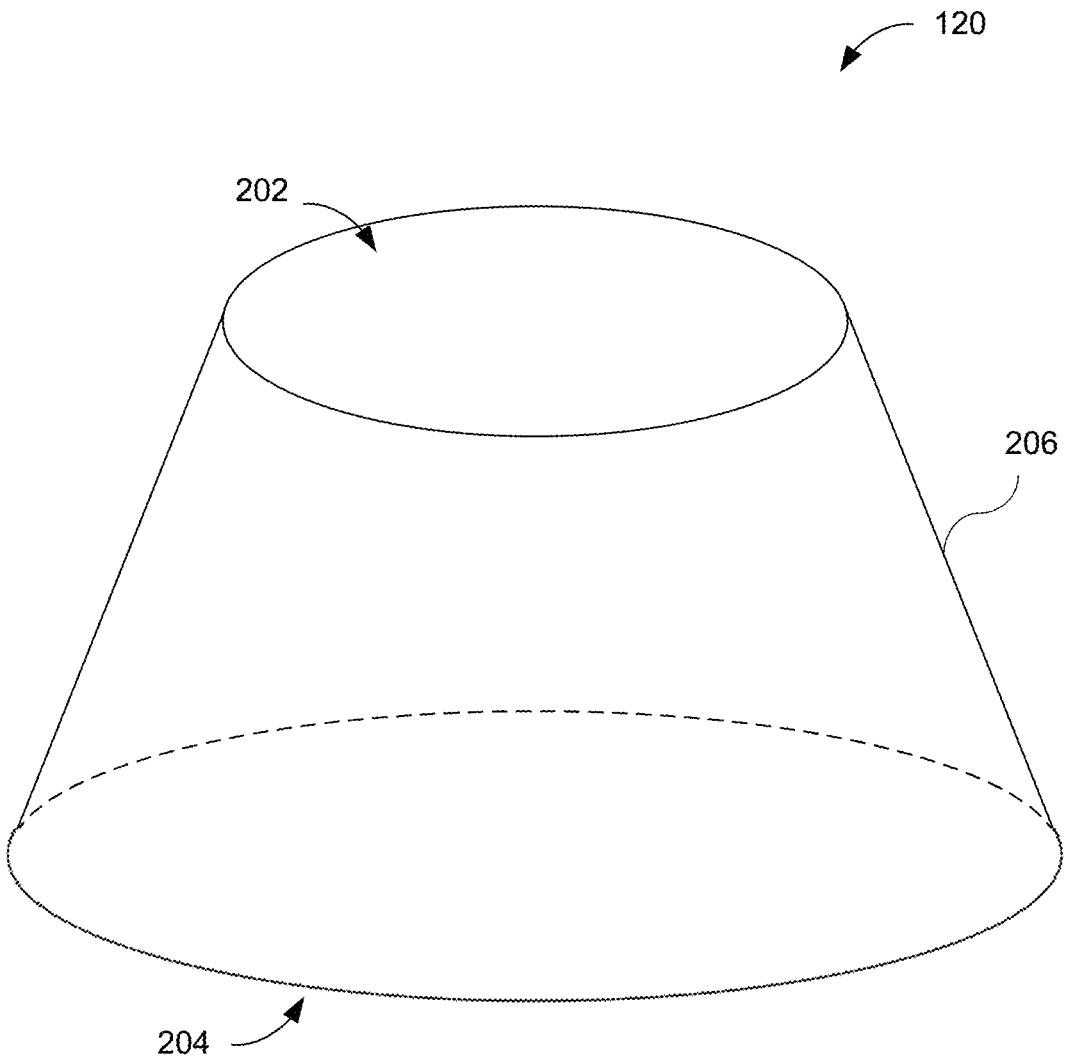
FIG. 2B illustrates a frustoconical combustion chamber, in accordance with the disclosed technology.
Figure 3A:
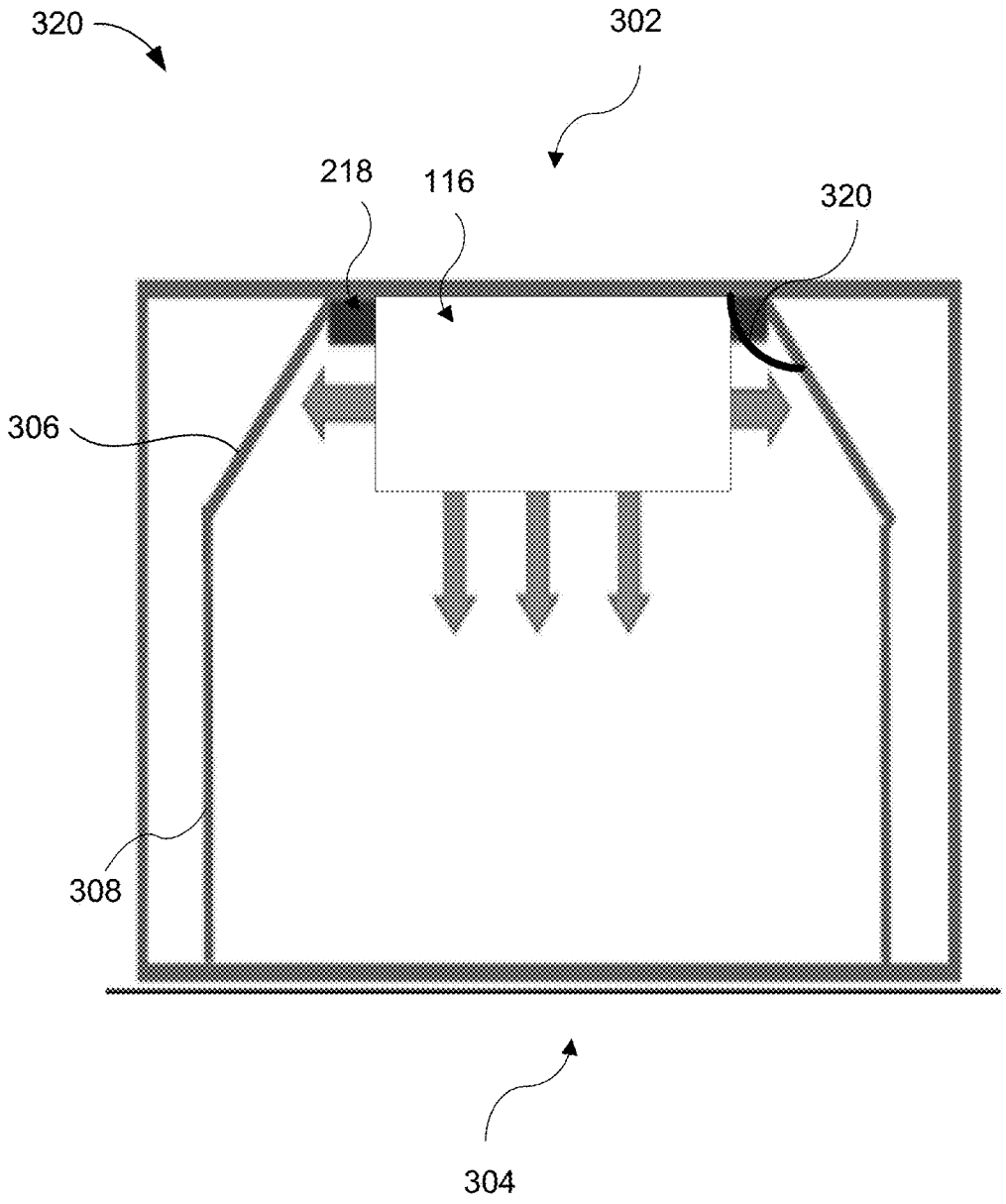
FIG. 3A illustrates a modified frustoconical combustion chamber, in accordance with the disclosed technology.
Figure 3B:
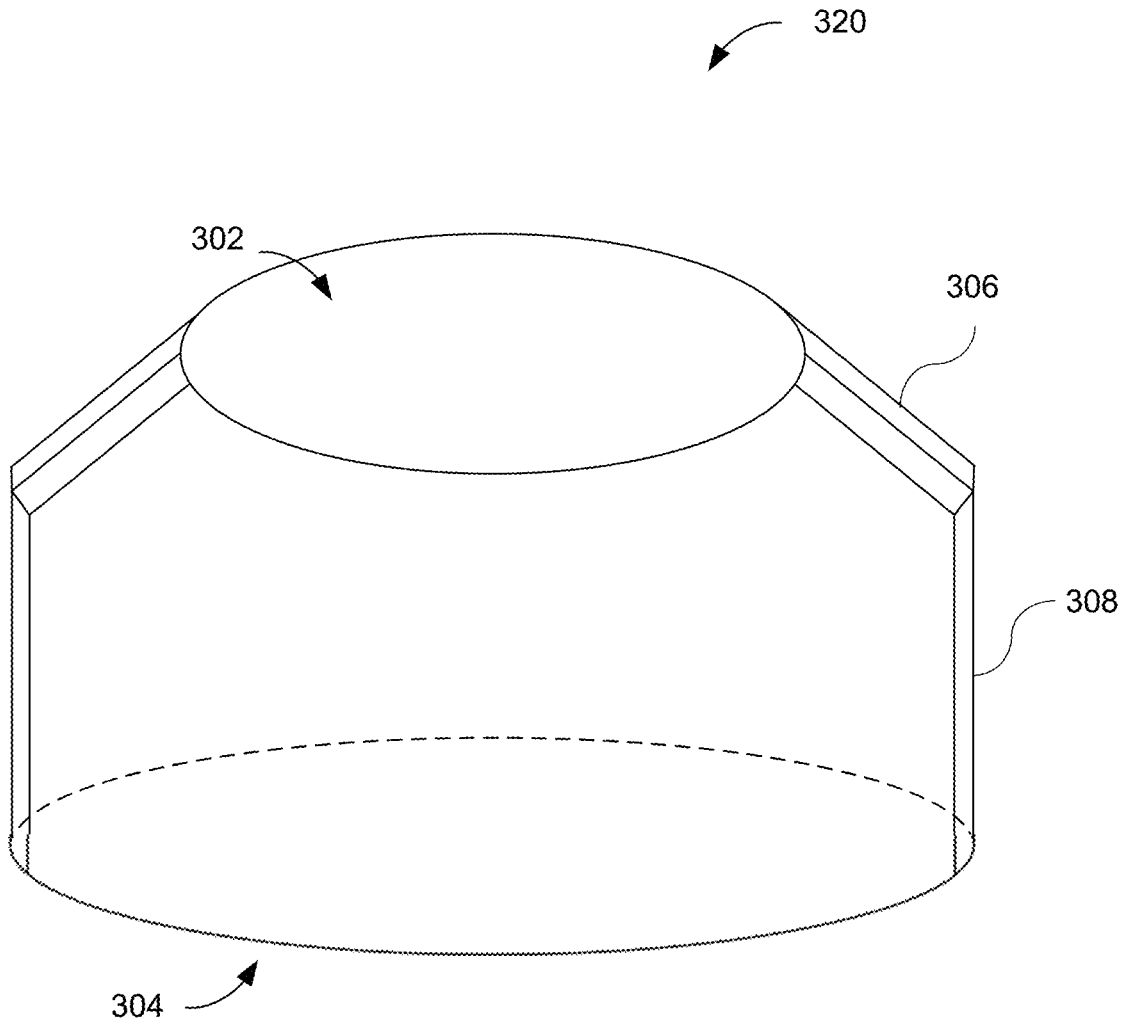
FIG. 3B illustrates a modified frustoconical combustion chamber, in accordance with the disclosed technology.

FIGS. 2A and 2B illustrate a first example of a frustoconical combustion chamber 120 and FIGS. 3A and 3B illustrate another example frustoconical combustion chamber 120. In each of FIGS. 2A-3B, a frustoconical combustion chamber 120, 320 can have a top end 202, 302, a bottom end 204, 304, and at least one angled sidewall 206, 306. The top end 202, 302 and bottom end 204, 304 can have a substantially circular configuration. Alternatively, the top end 202, 302 and the bottom end 204, 304 can have a different geometry, including elliptical, rectangular, and rectangular with rounded edges. The top end 202, 302 can have the same geometry as the bottom end 204, 304. Alternatively, the top end 202, 302 can have a geometry different from the geometry of the bottom end 204, 304.

The top end 202, 302 can have a first surface area and the bottom end 204, 304 can have a second surface area. The second surface area can be larger than the first surface area. As an example, the top end can have a diameter of approximately 29.5 inches, resulting in a first surface area of approximately 683.49 square inches, and the bottom end can have a diameter of approximately 30 inches, resulting in a second surface area of approximately 706.86 square inches. These dimensions can result in the second surface area being approximately 1.03 times larger than the first surface area. As another example, the top end can have a diameter of approximately 28 inches, resulting in a first surface area of approximately 615.75 square inches, and the bottom end can have a diameter of approximately 30 inches, resulting in a second surface area of approximately 706.86 square inches. These dimensions can result in the second surface area being approximately 1.15 times larger than the first surface area. The second surface area can be in a range from approximately 1.02 to approximately 1.2 times larger than the first surface area. The second surface area can be in a range from approximately 1.2 to approximately 3 times larger than the first surface area. The second surface area can be in a range from approximately 3 to approximately 6 times larger than the first surface area. The second surface area can be in a range from approximately 6 to approximately 9 times larger than the first surface area. The second surface area can be in a range from approximately 9 to approximately 12 times larger than the first surface area.

The top end 202, 302 can have a first diameter. Similarly, the bottom end 204, 304 can have a second diameter. In one embodiment, the second diameter can be larger than the first diameter. The second diameter can be in a range from approximately 1.02 to approximately 1.05 times larger than the first diameter. The second diameter can be in a range from approximately 1.05 to approximately 1.1 times larger than the first diameter. The second diameter can be in a range from approximately 1.1 to approximately 1.5 times larger than the first diameter. The second diameter can be in a range from approximately 1.5 to approximately 2 times larger than the first diameter. The second diameter can be in a range from approximately 2 to approximately 2.5 times larger than the first diameter. The second diameter can be in a range from approximately 2.5 to approximately 3 times larger than the first diameter. The second diameter can be in a range from approximately 3 to approximately 3.5 times larger than the first diameter. By way of example, the first diameter can be approximately 28 inches and the first-second diameter can be approximately 30 inches; therefore, the second diameter can be approximately 1.07 times larger than the first diameter. The difference in surface areas and diameters of the top end 202, 302 and bottom end 204, 304 of the combustion chamber 120, 320 can result in a frustoconical shape of the combustion chamber 120, 320.

The surface area of the top end 110 of the heat exchanger 108 can be substantially equal to the second surface area of the bottom end 204, 304 of the combustion chamber 120, 320. Additionally, a diameter of the top end 110 of the heat exchanger 120, 320 can be substantially equal to the second diameter of the combustion chamber 120, 320. This configuration can allow the heat exchanger 108 and the combustion chamber 120, 320 to be in direct alignment with each other, which can improve heat transfer efficiency as described above. The surface area of the top end 110 of the heat exchanger 108 can be larger than the second surface area of the bottom end 204, 304 of the combustion chamber 120, 320. For example, the tubes of the heat exchanger 108 can be clustered in a portion of the cross-sectional area of the heat exchanger 108 that is less than or equal to the surface area of the bottom end of the combustion chamber 120, 320.

The combustion chamber can be dimensioned such that a particular comparative ratio is formed between the diameter of the outer shell 102 and the first diameter of the combustion chamber 120, 320. For example, the combustion chamber 120, 320 can be dimensioned such that the diameter of the outer shell 102 can be in a range from approximately 1.05 times to approximately 1.1 times larger than the first diameter of the combustion chamber 120, 320. The diameter of the outer shell 102 can be in a range from approximately 1.1 to approximately 1.5 times larger than the first diameter of the combustion chamber 120, 320. The diameter of the outer shell 102 can be in a range from approximately 1.5 to approximately 2 times larger than the first diameter of the combustion chamber 120, 320. The diameter of the outer shell 102 can be in a range from approximately 2 to approximately 2.5 times larger than the first diameter of the combustion chamber 120, 320. The diameter of the outer shell 102 can be in a range from approximately 2.5 to approximately 3 times larger than the first diameter of the combustion chamber 120, 320. The diameter of the outer shell 102 can be in a range from approximately 3 to approximately 3.5 times larger than the first diameter of the combustion chamber 120, 320. By way of example, the diameter of the outer shell 102 can be approximately 33 inches and the first diameter can be approximately 28 inches; therefore, the outer shell 102 can be approximately 1.2 times larger than the first diameter.

The diameter of the outer shell 102 can be larger than the diameter of the heat exchanger 108 and/or the second diameter of the combustion chamber 120, 320. The diameter of the heat exchanger 108 can be equal to the second diameter of the combustion chamber 120, 320 (e.g., the combustion chamber 120, 320 can be affixed to the heat exchanger 108 such that the outer circumferences of the heat exchanger 108 and combustion chamber 120, 320 are aligned.) The space between an inner wall of the outer shell 102 and an outer wall of the heat exchanger 108 can provide a channel 138 for fluid to flow from the fluid inlet 104 to the fluid outlet 106, as illustrated in FIG. 1A. The width of the channel 138 (i.e., the difference between the inner wall of the outer shell 102 and the outer wall of the heat exchanger 108) can be in a range from approximately 0.25 inches to approximately 0.5 inches. As another example, the width of the channel 138 can be in a range from approximately 0.5 inches to approximately one inch. As another example, the width of the channel 138 can be in a range from approximately one inch to approximately 1.5 inches. As another example, the width of the channel 138 can be in a range from approximately 1.5 inches to approximately two inches. As another example, the width of the channel 138 can be sized in order to maximize heat transfer from the heat exchanger 108 to the fluid (i.e., minimize the amount of fluid that passes proximate the inner surface of the outer shell 102 without being sufficiently heated by the heat exchanger 108.

As will be appreciated, the frustoconical combustion chamber 120 can have a top end 202 with a smaller diameter than its bottom end 204. The smaller diameter of the top end 202 can help provide sufficient space for manufacturing or assembly of the fluid heating device, and the larger diameter of the bottom end 204 can provide a surface area that is substantially similar to the surface area of the top of the heat exchanger. Together, the difference in size between the first and second ends of the frustoconical combustion chamber can minimize the width of the channel 138 between the heat exchanger and the outer shell, thus improving heat transfer to passing fluid (e.g., as compared to traditional and/or cylindrical combustion chambers).

As illustrated in FIGS. 2A and 2B, the frustoconical combustion chamber can include two angled sidewalls 206 extending from the top end 202 to the bottom end 204. The angled sidewalls 206 can have an angle 220 of greater than 90.5 degrees, as illustrated in FIGS. 2A and 2B. The angled sidewalls 206 can have an angle 220 in a range from approximately 90.5 degrees to approximately 105 degrees. The angled sidewalls 206 can have an angle 220 in a range from approximately 105 degrees to approximately 120 degrees. The angled sidewalls 206 can have an angle 220 in a range from approximately 120 degrees to approximately 140 degrees. The optimal degree of angle 220 can vary depending on quality, size, and type of fuel in the air/fuel mixture and the length of the first diameter and second diameter. The angle 220 of the angled sidewall(s) 206 can be based on the shape of the igniter's outlet and/or the desired and/or optimized shape of the igniter output (e.g., flame shape). The angle 220 of each angled sidewall 206 can be equal. Alternatively, the angle 220 of each angled sidewall 206 can be different.

FIGS. 3A and 3B illustrate an alternative frustoconical combustion chamber 320. A substantially hybrid frustoconical combustion chamber 320 can include a top surface 302, a bottom surface 304, at least one angled sidewall 306, and at least one vertical sidewall 308. As illustrated in FIGS. 3A and 3B, the hybrid frustoconical combustion chamber 320 can include a top surface 302, a bottom surface 304, two angled sidewalls 306, and two vertical sidewalls 308. The hybrid frustoconical combustion chamber 320 can include at least one corner disposed between adjacent angled sidewalls. The angled sidewall 306 can be less than the length of the vertical sidewall 308. The angled sidewall 306 can be approximately one half the length of the vertical sidewall 308. The angled sidewall 306 can be more than approximately half the length of the vertical sidewall 308. The angle 320 of the angled sidewall 306 can be greater than 90.5 degrees. The angle 320 of the angled sidewall 306 can be in any of the ranges discussed above with respect to FIGS. 3A and 3B. The optimal degree of angle 320 can vary depending on quality, size, and type of fuel in the air/fuel mixture and the length of the first diameter and second diameter. The angle 320 of the angled sidewall(s) 306 can be based on the shape of the igniter's outlet and/or the desired and/or optimized shape of the igniter output (e.g., flame shape). The angle 320 of each angled sidewall 306 can be equal. Alternatively, the angle 320 of some or all of the angled sidewalls 306 can be different.

The angled sidewalls 206 of the frustoconical and the angled sidewalls 306 and vertical sidewalls 308 of the hybrid frustoconical combustion chamber can be substantially flat. Alternatively or in addition to, at least a portion of the angled sidewalls 206, 306 and/or vertical sidewalls 308 can be curved. Alternatively or in addition to, at least a portion of the angled sidewalls 206, 306 and/or vertical sidewalls 308 can be corrugated. In one example, the entire angled sidewall 206 and/or vertical sidewall 308 can be corrugated. The corrugated sidewall 206, 306, 308 can comprise rounded ridges and/or teeth-like ridges.

Refractory lining 218 can be positioned on or near the top end 202, 302 of the combustion chamber 120, 320. The igniter 116 can be located substantially within the gap 130 formed between the top end 202, 302 of the combustion chamber 120, 320 and the outer shell 102, which may reduce the amount of refractory lining 218 needed to insulate the outer shell 102.

Figure 4:
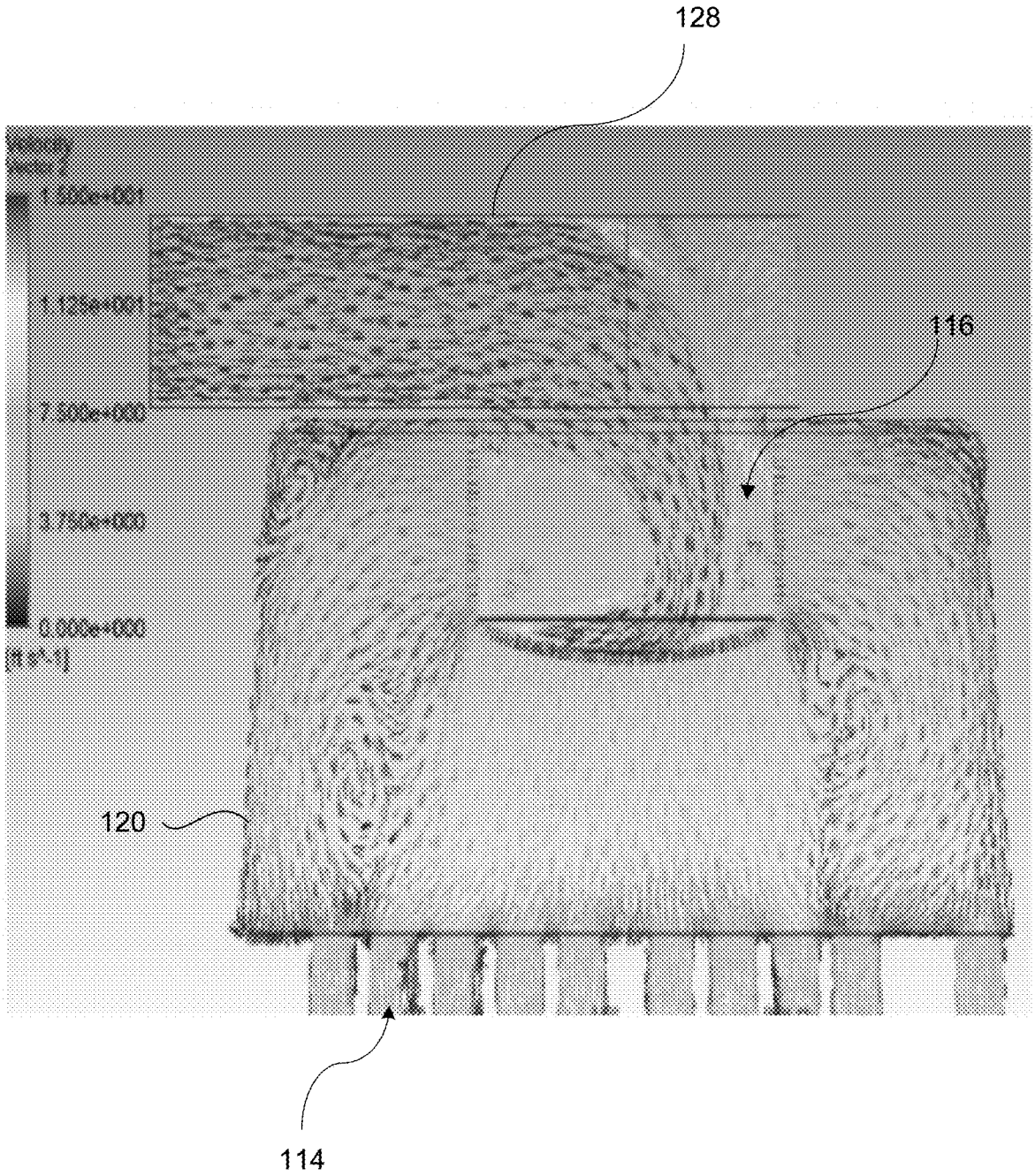
FIG. 4 illustrates a diagram of a flow of combustion gas in a fluid heating device, in accordance with the disclosed technology.
Figure 5:
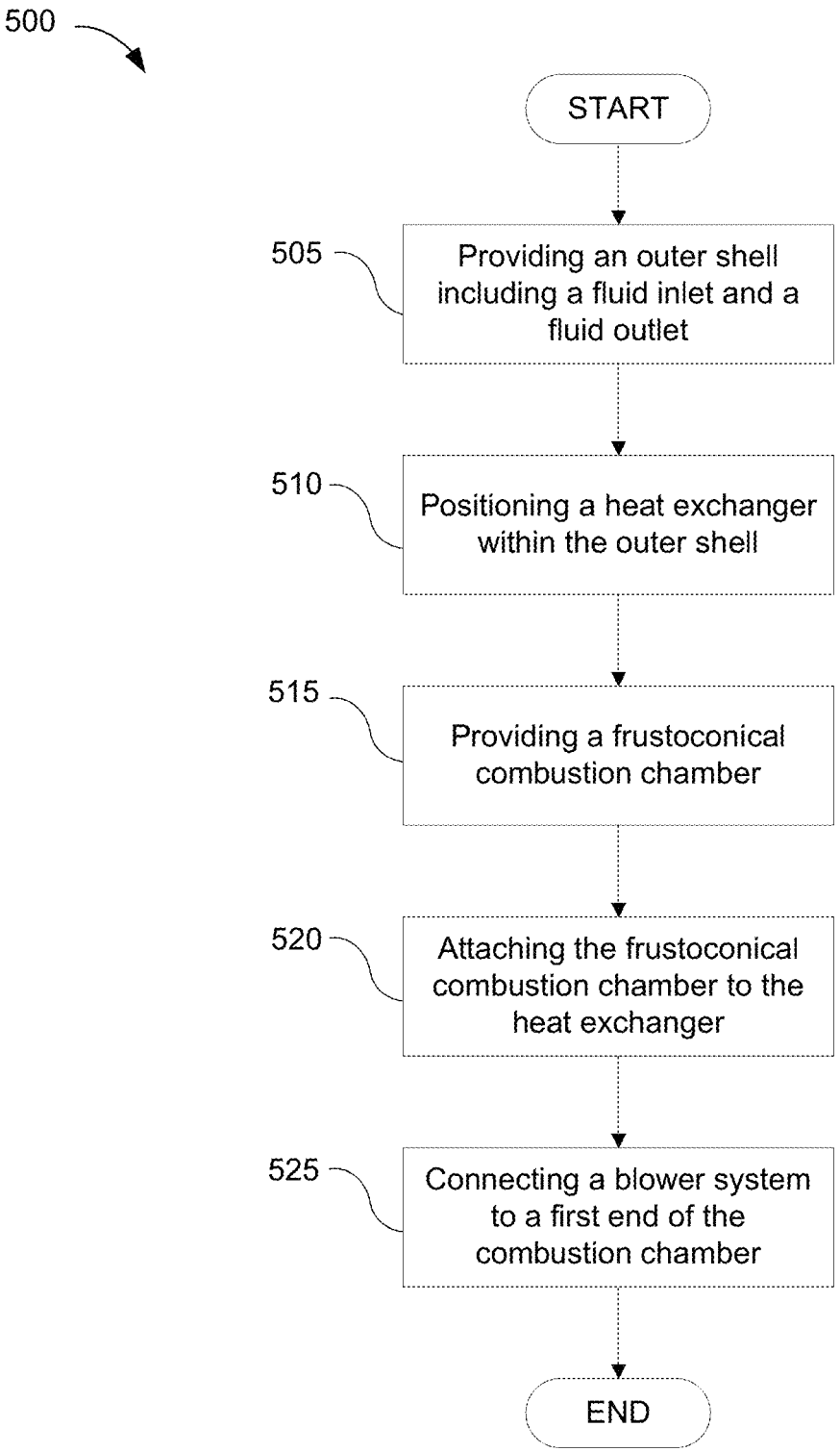
FIG. 5 illustrates a flow diagram outlining the steps for manufacturing a fluid heating device, in accordance with the present invention.

FIG. 4 illustrates an example flow pattern of combustion gases within the combustion chamber 120 and through multiple tubes 114 of the heat exchanger 108. As shown, the air/fuel mixture can flow from the blower 122 to the manifold 128. The blower 122 can push the air/fuel mixture through the manifold 128 and into the combustion chamber 120 at a high velocity. The air/fuel mixture can enter the combustion chamber 120 near the igniter 116. Upon interaction with the igniter 116, the air/fuel mixture can ignite, and a resulting combustion process can occur, producing hot combustion gases. The combustion gases can flow through the combustion chamber 120 in a generally frustoconical flow shape or configuration, and can flow to and through the tubes 114 of the heat exchanger 108. As will be appreciated, the frustoconical shape of the combustion chamber 120 can substantially mimic the flow shape of the combustion gases flowing through the combustion chamber, which can reduce the amount of recirculation within the combustion chamber 120 and thus improve heat transfer efficiency of the system.

The disclosed technology can also include a method of manufacturing a fluid heating device 100. The method 500 can include providing 505 an outer shell 102. The method 500 can include rolling one or more layers of metal and attaching the ends of each layer together to form a cylinder or some other useful shape. Depending on the target use of the fluid heating device 100, the outer shell 102 can be configured to hold at least 20 gallons of fluid, for example. As another example, the outer shell 102 can be configured to hold at least 150 gallons of fluid. The method 500 can include forming (e.g., cutting, punching, drilling) a plurality of connection points in the outer shell 102. The plurality of connection points can be configured to provide the location of fluid entry, fluid exit, and combustion gas exit.

The method 500 can include positioning 510 a heat exchanger 108 within an outer shell 102. The method 500 can include positioning the heat exchanger 108 within the outer shell 102 such that the heat exchanger 108 and outer shell 102 are coaxially aligned. The method 500 can optionally include coating one or more portions of the heat exchanger 108 with one or more ceramics, composites, or plastic polymers. The method can include attaching or affixing an outlet tube sheet 142 to a bottom end 112 of the heat exchanger 108. The outlet tube sheet 142 and/or inlet tube sheet 140 can be welded or otherwise attached the heat exchanger. The method can include inserting tubes 114 into apertures of the outlet tube sheet 142 such that each aperture receives a tube 114, or attaching the tubes 114 to the outlet tube sheet 142 such that the tubes 114 are substantially aligned with the apertures. The method can include positioning one or more baffles within heat exchanger. The inlet tube sheet 140 can be positioned and attached (e.g., welded) on or near the top end 110 of the heat exchanger 108 such that each aperture of the inlet tube sheet 140 receives or substantially aligns with a tube 114. The inlet tube sheet 140 and the outlet tube sheet 142 can include equal number of apertures, allowing each tube 114 to extend from an aperture of the outlet tube sheet 142 to an aperture of the inlet tube sheet 140. The aperture of the outlet tube sheet 142 can be vertically aligned with the aperture of the inlet tube sheet 140.

The method 500 can include providing 515 a frustoconical combustion chamber 120, 320. The method can include rolling a sheet of material (e.g., metal), cutting a frustoconical blank, and attaching opposite ends of the blank to form a frustoconical shape. The method can include bending portions of the blank before attaching the ends to, for example, form corners on the resulting three-dimensional form.

The method 500 can include attaching 520 the frustoconical combustion chamber 120, 320 to the heat exchanger 108. For example, the method can include attaching or affixing (e.g., welding) the frustoconical combustion chamber 120, 320 to an outer circumference of the top surface 110 of the heat exchanger 108. Alternatively, the method can include detachably attaching the frustoconical combustion chamber 120, 320 to the top surface 110 of the heat exchanger 108 (e.g., via bolts). The method can include aligning the frustoconical combustion chamber 120, 320 with the heat exchanger 108 such that the outer circumference of the frustoconical combustion chamber 120, 320 and the outer circumference of the heat exchanger 108 are substantially flush. The fluid communication can allow for the combustion gases produced in the combustion chamber 120 to flow through the apertures of the inlet tube sheet 140 and through the plurality of tubes 114.

The method 500 can include connecting 525 a blower system 118 to the first end of the frustoconical combustion chamber 120, 320. The blower system can include a blower 122, an air inlet 124, a fuel inlet 126, and/or a manifold 128. The method can include attaching or affixing (e.g., welding) the manifold 128 to the fluid heating device (e.g., at or near the top end 134 of the outer shell 102). The method can include installing the manifold 128 such that outlet(s) of the manifold 128 are in fluid communication with the combustion chamber 120. The method can include attaching or affixing the blower 122 to the fluid heating device (e.g., at or near the top end 134 of the outer shell 102) atop or otherwise near the manifold 128. The method can include connecting the air inlet 124 and the fuel inlet 126 to the blower 122 such that the blower 122 can receive air from an air source and fuel from a fuel source.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

What is claimed is:

1. A fluid heating device comprising:

an outer shell having a fluid inlet and a fluid outlet, the outer shell defining a fluid heating volume for heating fluid;

a heat exchanger including heating tubes that are each fluidly isolated from the fluid heating volume, the heat exchanger being concentrically disposed with respect to the outer shell such that a channel is formed between an inner surface of the outer shell and an outer surface of the heat exchanger; and a combustion chamber having a substantially frustoconical shape in fluid connection with the heating tubes of the heat exchanger, the combustion chamber including:

a first end having a first surface area;

a second end having a second surface area that is larger than the first surface area, the second end being in fluid connection with the heating tubes of the heat exchanger; and at least one angled sidewall including an angled portion that extends along a portion of a height of the combustion chamber, wherein the angled portion has an angle relative to the first end of from 90.5 degrees to 120 degrees, and wherein the fluid outlet is positioned in the outer shell at the second end of the combustion chamber.

2. The fluid heating device of claim 1, wherein the combustion chamber has at least one corner.

3. The fluid heating device of claim 2, wherein the combustion chamber includes a first angled sidewall and a second angled sidewall.

4. The fluid heating device of claim 1, wherein the combustion chamber includes a first angled sidewall and a second angled sidewall.

5. The fluid heating device of claim 1, wherein the second surface area is in the range of approximately 1.02 times and approximately 9 times larger than the first surface area.

6. The fluid heating device of claim 1, wherein the first end has a first diameter and the second end has a second diameter, the second diameter being in the range of approximately 1.02 times and approximately 3 times larger than the first diameter.

7. The fluid heating device of claim 1, wherein the outer shell has a diameter larger than a diameter of the heat exchanger.

8. Fluid heating device of claim 7, wherein the channel has a width in a range between approximately 0.25 inches and approximately 1.5 inches.

9. The fluid heating device of claim 7, wherein the diameter of the outer shell is in a range between approximately 1.05 times and approximately 3.5 times larger than a first diameter of the first end of the combustion chamber.

10. The fluid heating device of claim 1, wherein at least a portion of a sidewall of the combustion chamber is corrugated.

11. The fluid heating device of claim 1, wherein a flow of combustion gas through the combustion chamber substantially correlates to a shape of the combustion chamber.

12. The fluid heating device of claim 1, wherein the angled portion of the at least one angled sidewall has an angle relative to the first end of approximately 96 degrees.

13. The fluid heating device of claim 1, further comprising an igniter positioned within the combustion chamber proximal to the first end and configured to expel combustion gases towards the second end and towards the at least one angled sidewall such that the substantially frustoconical shape directs the flow of combustion gases to the heating tubes of the heating exchanger.

14. The fluid heating device of claim 1, wherein a gap is formed proximate the first end of the combustion chamber between an exterior surface of the combustion chamber and the inner surface of the outer shell.

15. A method for manufacturing a fluid heating device, the method comprising:

providing an outer shell including a fluid inlet and a fluid outlet;

positioning a heat exchanger concentrically within the outer shell such that a channel is formed between an inner surface of the outer shell and an outer surface of the heat exchanger, the heat exchanger including an inlet tube sheet disposed proximate a first end of the heat exchanger, an outlet tube sheet disposed proximate a second end of the heat exchanger, and a plurality of heating tubes extending between the inlet tube sheet and the outlet tube sheet;

providing a combustion chamber having a substantially frustoconical shape, a first end that has a first surface area, second end that has a second surface area larger than the first surface area, wherein the fluid outlet is positioned in the outer shell at the second end of the combustion chamber, and at least one angled sidewall including an angled portion that extends along a portion of a height of the combustion chamber, the angled portion having an angle relative to the first end of from 90.5 degrees to 120 degrees;

attaching the combustion chamber to the heat exchanger such that the combustion chamber is in fluid communication with the plurality of heating tubes; and connecting a blower system to the first end of the combustion chamber, the blower system being configured to provide an air/fuel mixture to the combustion chamber.

16. The method of claim 15, wherein the heat exchanger is positioned in a substantially coaxial location with respect to the outer shell.

17. The method of claim 15, wherein an outer edge of the combustion chamber is substantially flush with an outer edge of a top surface of the heat exchanger.

18. The method of claim 15, wherein the channel has a width in a range between approximately 0.25 inches and approximately 1.5 inches.

19. The method of claim 15, wherein the angled portion of the at least one angled sidewall has an angle relative to the first end of approximately 96 degrees.

* * * * *